US007331066B1

(12) United States Patent
Ramos

(10) Patent No.: US 7,331,066 B1
(45) Date of Patent: Feb. 19, 2008

(54) VENTILATION SYSTEM FOR MULTIPLE TOILETS IN A BUILDING

(76) Inventor: Angel B. Ramos, P.O. Box 5241, Hercules, CA (US) 94547

( * ) Notice: Subject to any disclaimer, the term of this patent is extended or adjusted under 35 U.S.C. 154(b) by 56 days.

(21) Appl. No.: 11/426,085

(22) Filed: Jun. 23, 2006

(51) Int. Cl.
*E03D 9/04* (2006.01)
*E03D 9/05* (2006.01)

(52) U.S. Cl. ..... 4/213; 4/349; 4/352; 4/216

(58) Field of Classification Search ..... 4/352, 4/213–216, 347–351
See application file for complete search history.

(56) References Cited

U.S. PATENT DOCUMENTS 1,401,091 A * 12/1921 Lucas ..... 4/213
2,001,593 A 5/1935 Teetor
2,079,733 A 5/1937 Cummings
2,726,405 A 12/1955 Smith et al.
2,743,462 A * 5/1956 McMillan ..... 4/213
3,491,382 A 1/1970 Poister
3,501,784 A 3/1970 Maisch
3,790,970 A 2/1974 Bendersky et al.
3,805,304 A * 4/1974 Ikehata ..... 4/352
4,590,629 A 5/1986 Lusk
4,620,329 A 11/1986 Wix
D328,340 S 7/1992 Bolduc
5,161,262 A 11/1992 Quaintance, Sr.
5,671,484 A 9/1997 Lee, III
5,819,324 A * 10/1998 Bianco ..... 4/213
5,850,638 A 12/1998 Her
6,082,979 A 7/2000 Friedman
6,260,214 B1 7/2001 Smith
6,496,986 B1 12/2002 Lumsden
6,526,598 B1 3/2003 Black
6,553,581 B1 4/2003 Lee
6,760,928 B1 7/2004 Rodriguez
6,772,449 B1 8/2004 Wolfe
6,804,837 B1 10/2004 Guess, Sr.
6,928,666 B1 8/2005 Schaffer
6,983,491 B2 1/2006 Curtis et al.

* cited by examiner

*Primary Examiner*—Kristie A. Mahone
(74) *Attorney, Agent, or Firm*—Charles L. Thoeming

(57) ABSTRACT

Separate air evacuation opening and a separate manifold are formed in the toilet bowl rim for full and separate air evacuation of the toilet bowl before, during or after flushing. The exhaust assembly includes and is activated by a fan and motor exhaust assembly comprising an activation switch, one way valve, and control circuit. A piping network provides exhaust from one or more connected dwelling toilets to the dwelling exterior.

7 Claims, 2 Drawing Sheets

VENTILATION SYSTEM FOR MULTIPLE TOILETS IN A BUILDING

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention relates to elimination of noxious air in and around a toilet bowl while being used by a person, and more particularly to a modified toilet bowl structure in bathrooms. Fowl air is drawn into openings or vents of a separate exhaust manifold within the rim structure of the modified toilet bowl. The air is transferred to the exterior of the building or to some scrubbing system using a fan and motor and evacuation conduit system from one or more modified toilets.

2. Background of the Invention

Many fowl air removal apparatus and methods for a toilet used by a person have been patented. Such apparatus and/or methods consider familiar, expected and obvious structural configurations, notwithstanding the myriad of designs encompassed by the art developed for the fulfillment of countless related objects and requirements.

A preliminary search located the following patents which are believed to be representative of the present state of the prior art: U.S. Pat. No. 2,001,593, issued May 14, 1935; U.S. Pat. No. 2,079,733, issued May 11, 1937; U.S. Pat. No. 2,726,405, issued Dec. 13, 1955; U.S. Pat. No. 3,491,382, issued Jan. 27, 1970; U.S. Pat. No. 3,501,784, issued Mar. 24, 1970; U.S. Pat. No. 3,790,970, issued Feb. 12, 1974; U.S. Pat. No. 4,590,629, issued May 27, 1986; U.S. Pat. No. 4,620,329, issued Nov. 4, 1986; U.S. Pat. No. Des. 328,340, issued Jul. 28, 1992; U.S. Pat. No. 5,161,262, issued Nov. 10, 1992; U.S. Pat. No. 5,671,484, issued Sep. 30, 1997; U.S. Pat. No. 5,850,638, issued Dec. 22, 1998; U.S. Pat. No. 6,082,979, issued Jul. 4, 2000; U.S. Pat. No. 6,260,214 B1, issued Jul. 17, 2001; U.S. Pat. No. 6,496,986 B1, issued Dec. 24, 2002, U.S. Pat. No. 6,526,598 B1, issued Mar. 4, 2003; U.S. Pat. No. 6,553,581 B1, issued Apr. 29, 2003; U.S. Pat. No. 6,496,986 B1, issued Dec. 24, 2002; U.S. Pat. No. 6,760,928 B1, issued Jul. 13, 2004; U.S. Pat. No. 6,804,837 B1, issued Oct. 19, 2004; U.S. Pat. No. 6,928,666 B1, issued Aug. 16, 2005; and U.S. Pat. No. 6,983,491 B2, issued Jan. 10, 2006.

BRIEF SUMMARY OF THE INVENTION

It is an objective of the present invention to provide a system for exhausting noxious odors emanating from one or more toilet bowls.

It is an another objective of the present invention to provide an improved toilet bowl comprising an integrated manifold manufactured within the bowl upper rim to provide a conduit for full and separate air evacuation of the toilet bowl before, during or after flushing.

It is a further objective of the present invention to provide an air exhaust mechanism adequately sized and scaled to efficiently and completely provide air evacuation capacity from one or more toilet bowls connected in parallel thereto.

Yet another intended and desired feature of the present invention is to provide automatic activation of the air evacuation system from each toilet bowl.

Still another intended and desired feature of the present invention is to provide automatic valve isolation of the noxious air evacuation manifold for each toilet bowl in the system.

It is a further purpose of the present invention to provide a system for evacuation of noxious odors from one or more toilet bowls that is simple and economical.

Still a further purpose of the present invention to provide such an air evacuation system suitable for commercial and residential applications.

In order to accomplish the above objects, there is provided separate air evacuation openings and a separate manufactured air manifold formed in the rim of the toilet bowl for full and separate air evacuation of the toilet bowl to occur before, during, or after flushing depending upon activation of a fan and motor exhaust assembly exterior of the building. The exhaust assembly is activated through a control circuit that includes an activation switch energized by a person seated on the seat portion on top of the toilet bowl.

The exhaust assembly is in air contact with the air manifold via a piping network. Accordingly, noxious odors are easily removed from the toilet bowl. The exhaust assembly is not activated by the weight of the toilet seat and/or toilet lid alone. Additional pressure must be provided to activate the air evacuation system of the present invention, usually by the weight of a person sitting on the toilet seat or by hand pressure in the vicinity of the switch position. Additionally, the exhaust piping network is extended in the space between interior walls upward and downward to additional toilet bowls in separate locations within the building. Hence, multiple evacuation is provided.

Other features, advantages, and objects of the present invention will become apparent with reference to the following description and accompanying drawings.

BRIEF DESCRIPTION OF DRAWINGS

The accompanying drawings, which are incorporated into and form a part of the disclosure, illustrate an embodiment of the invention, and together with the description, serve to explain the principles of the invention. It should be understood that, because of the great disparity between various features depicted in the same drawing, the following drawings are not necessarily drawn to scale; it is intended that they be merely illustrative of the process.

DETAILED DESCRIPTION OF THE INVENTION

Figure 1:
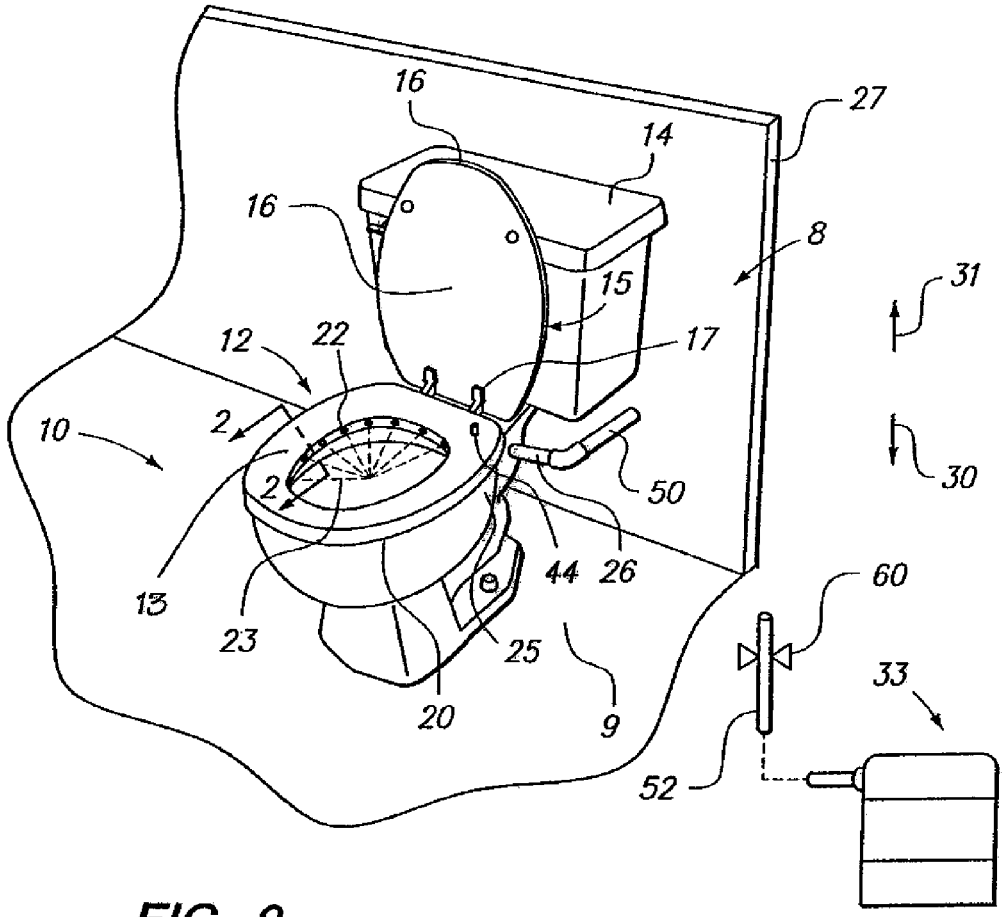
FIG. 1 is a perspective view of a modified toilet bowl according to an embodiment of the present invention having a plurality of openings connecting the interior bowl to a manifold and including a switch button located above the seat for controlling operation of an exterior fan and motor assembly [not shown], such assembly having air connection to the openings.
Figure 2:
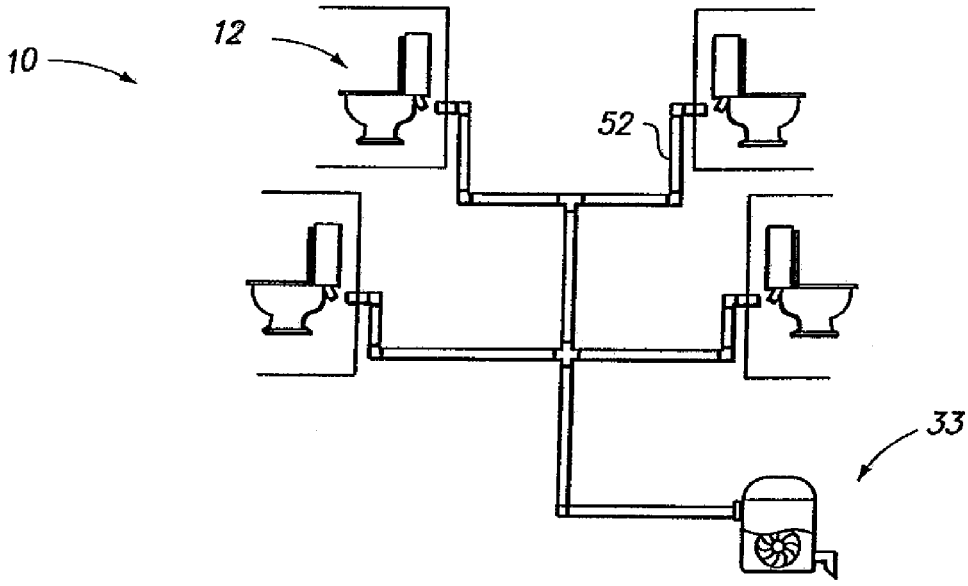
FIG. 2 is a schematic depicting hollow tubular conduit connecting a plurality of toilets of the present invention to an exterior fan and motor assembly to exhaust foul odors to the exterior of the dwelling housing the toilets.

With reference to the drawing figures, an embodiment of the present invention for a ventilation system 10 is partially shown and the system includes a toilet bowl 12 having interior and exterior surfaces, and attached to a bathroom floor 9. A tank 14 is attached to the toilet bowl 12 for flushing purposes. The upper rim of the toilet bowl 12 is equipped with and supports a seat assembly 15 comprising seat 13 and lid 16 hinged via pintle assembly 17.

The toilet bowl 12 includes an upper rim 20 provided with a series of openings 22 having axes of symmetry 23 converging towards the center of the toilet bowl 12. Each opening 22 is connected to an interior manifold 24 within the rim upper rim 20 or upper rim duct 21. The interior manifold 24 is aligned within and runs connectedly within the upper rim 20 or upper rim duct 21 to provide an integral, waterproof and airtight passageway from the toilet bowl 12 interior surface through the upper rim 20 or first upper rim duct 21. The interior manifold 24 has a large egress 25 at the toilet back platform 26. The egress 25 is threaded to connect to a piping network that extends through a bathroom wall 27 to other similarly configured toilets in the building depicted by the upward directional arrow 31. A fan and motor exhaust assembly 33 in line with the piping network depicted by the downward directional arrow 30 at the building exterior is sized to delivery adequate suction through the system piping network 52.

A modified toilet bowl 12 to ventilate noxious odors emanating therefrom according to the present invention therefor comprises interior and exterior surfaces. The toilet bowl 12 further comprises a toilet bowl rim having an upper rim 20 comprising a first upper rim duct 21 having a plurality of water discharge openings 80 cast therein. A toilet seat 13 and lid 16 are positioned on the upper rim 20. A plurality of air intake openings 22 connect the first upper rim duct 21 to the internal toilet bowl space surrounded by and defined by the toilet bowl 12 interior surface. The improved toilet bowl 12 of the present invention further comprises manifold means 24 within the toilet bowl 12 upper rim 20 or first upper rim duct 21. The manifold means 24 has a uniform diameter running throughout the upper rim 20 or first upper rim duct 21. The manifold means 24 communicates with the toilet bowl interior surface via the air intake openings 22 from the upper rim 20 or first upper rim duct 21 to the toilet bowl 12 interior surface, whereby the manifold means 24 and openings 22 provide an integral, waterproof and airtight passageway from the toilet bowl 12 interior surface through the upper rim 20 or first upper rim duct 21. The assembly of the manifold means 24 and openings 22 in relation to the first upper rim duct 21 allows for operation of the ventilation system during toilet flushing since the air intake from the toilet bowl interior space is not effected by the water discharging through the openings 80. Similarly, no water enters the ventilation system since the air intake openings 22 extend sufficiently beyond the water discharge openings on the upper rim 20.

A vent pipe 26 is connected to manifold means 24 and the vent pipe 26 has an end extending from the toilet bowl exterior surface. A hollow flexible tubing 50 having two ends with a first end connected to the vent pipe 26 end extending from the toilet bowl exterior surface, and a second flexible tubing end is provided. Hollow tubular means 52 is connected to the second flexible tubing end.

The improved toilet 12 of the present invention further comprises one-way valve means 60 within the hollow tubular means 52, airflow means 31 in line with the hollow tubular means, and activation means 45 for the airflow means and one-way valve means.

Figure 3A:
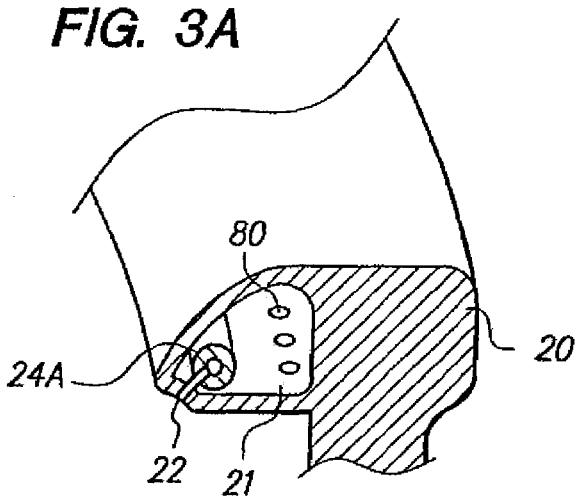
FIG. 3A is a section taken along line 2-2 of FIG. 1, depicting an embodiment of the present invention wherein the manifold comprises tubing manufactured within the upper rim duct.

In the preferred embodiment of the present invention, manifold means 24 comprises a non-collapsible, flexible hollow tubular means 24A running throughout the upper rim duct 21, FIG. 3A.

Figure 3B:
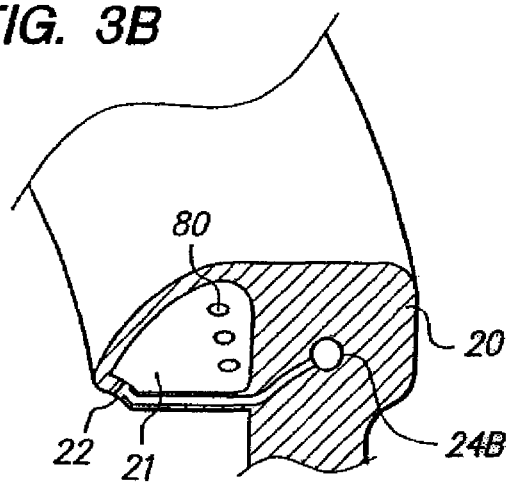
FIG. 3B is a section taken along line 2-2 of FIG. 1, depicting another embodiment of the present invention wherein the manifold comprises a separate duct manufactured within the upper rim.
Figure 4:
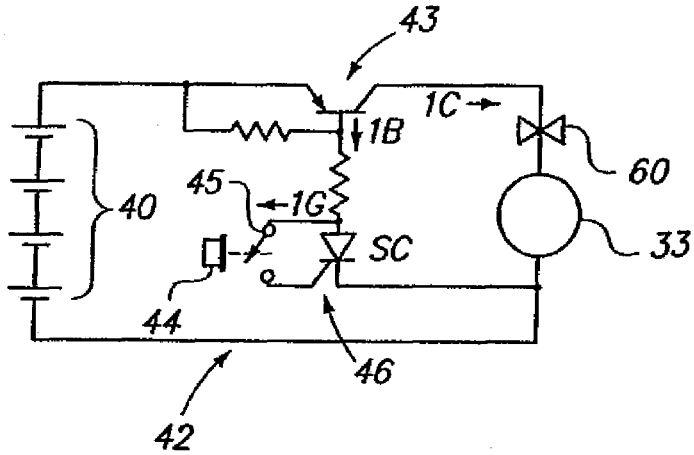
FIG. 4 is a circuit diagram of a control circuit 42 for operation of the fan and motor assembly and one-way valve assembly of an embodiment of the present invention.

In a second embodiment of the present invention, manifold means 24 comprises a second duct 24B cast within and running throughout the upper rim 20, FIG. 3B.

Airflow means 31 comprises apparatus selected from the group consisting of a vacuum pump assembly, suction blower assembly, and exhaust fan and motor assembly.

One-way valve means 60 comprises apparatus selected from the group consisting of a flapper valve, and a check valve.

Activation means comprises a switch 45 and electrical circuitry 42 assembly whereby once a switch is engaged, airflow means 33 is activated and one-way valve means 60 is aligned in accordance with flow in the direction of desired evacuation. In the preferred embodiment of the present invention the switch and electrical circuitry assembly further includes pressure activation assembly comprising a push button 44 on the toilet upper rim 20 under the seat 13 (not shown). Alternatively, the activation assembly push button 44 can extend from the toilet upper rim 20 through the seat 13, FIG. 1.

As shown for the preferred embodiment of the present invention, batteries or other power source 40 provide the electrical energy for fan and motor 33 and the control circuit 42. The control circuit 42 comprises a transistor 43, push button 44, controlling switch 45, and a coacting thyristor 46. In the preferred embodiment of the present invention, the push button 44 controlling the switch 45 moves vertically in response to the weight of the toilet user and extends above the upper rim 20 of the toilet bowl 12, or above the seat 13. The switch is not activated by the weight of the toilet seat 13 and/or the toilet lid 16 alone. Hence, additional pressure must be provided to activate the switch 45 usually by a person sitting on the toilet seat or by hand pressure in the vicinity of the switch 45. When the user is seated upon the toilet seat, the switch 45 closes and the thyristor 46 conducts due to the production of gate current 1G. A relatively high base current 1B will then flow through the transistor 43 and the thyristor 46 causing the production of a large drive current 1C to operate the fan and motor 33 and open valve means 60. Opening of the switch 45 causes the transistor 43 and the thyristor 46 to revert to a non-conductive state and de-energize the fan and motor 33 and close valve means 60.

Accordingly, the preferred embodiment of the present invention for an improved toilet bowl 12 to ventilate noxious odors emanating therefrom, comprises a toilet bowl 12 having both an interior surface and an exterior surface. The preferred embodiment of the present invention further comprises a toilet bowl 12 having an upper rim 20 comprising an upper rim duct 21 cast therein and a toilet seat 13 and lid 16 positioned on the upper rim 20. The preferred embodiment of the present invention further comprises a plurality of air intake openings 22 from the upper rim duct 21 to the toilet bowl interior surface, and a non-collapsible, flexible hollow tube 24A running throughout the upper rim duct 21 within the toilet bowl rim of uniform diameter running throughout the upper rim, the tube 24A communicating with the toilet bowl interior surface via the air intake openings 22 from the upper rim duct 21 to the toilet bowl interior surface, whereby the tube 24A and openings 22 provide an integral, waterproof and airtight passageway from the toilet bowl interior surface through the upper rim 20. The preferred embodiment of the present invention further comprises a vent pipe 26 connected to the tube 24 and having an end extending from the toilet bowl 12 exterior surface, hollow flexible tubing 50 having two ends with a first end connected to the vent pipe 26 end extending from the toilet bowl exterior surface, and a second flexible tubing end. The preferred embodiment of the present invention further comprises hollow tubular conduit 52 connected to the second flexible tubing end, a one-way valve 60 within the hollow tubular conduit 52, an exhaust fan and motor assembly 33 in line with the hollow tubular conduit 52, and a pressure activation switch and electrical circuitry assembly 42 whereby once the switch 45 is engaged, airflow means 41 is activated and the one-way valve 60 is aligned in accordance with flow in the direction of desired evacuation. Depending upon the consumer preferences, the hollow flexible tubing 50 and the vent pipe 26 can be aligned directly behind the toilet (not shown) or positioned from the side of the rear portion of the upper rim 20, FIG. 1.

According to the present invention, a system 10 for evacuating noxious odors from one or more toilets, is provided comprising in combination: at least one toilet bowl 12 according to an embodiment of the present invention installed at a predetermined location within a dwelling; conduit 52 of predetermined diameter and length connecting each hollow tubular means 52 of one or more toilets in parallel to a central exhaust pipe 52 of even diameter and predetermined length and having an exhaust end, whereby the connecting conduit 52 and exhaust pipe 52 are installed within the dwelling framing at the time of construction such that the conduit 52 and exhaust pipe 52 function behind to be finished wall, ceiling and floor surfaces, and whereby the exhaust end 33 is on the exterior of the dwelling; and wherein airflow means 33 is in line with the exhaust pipe 52 and on the exterior of the dwelling such that when activated, noxious air is ventilated from one or more toilets to the dwelling exterior before, during, or after flushing the toilets 12 in use.

As to the manner of usage and operation of the toilet ventilation system or an individual toilet component of the same, and the means of electrical power necessary to practice the present invention, the same should be apparent from the above description and the art. Accordingly, no further discussion relating to the manner of usage, operation, or current means to power the present invention will be provided.

Although the invention has been described in some detail with reference to the preferred embodiment and alternatives, those of skill in the art will realize, in light of the teachings herein, that certain changes and modifications can be made without departing from the spirit and scope of the invention. Accordingly, the invention is limited only by the claims of any subsequent United States non-provisional or foreign patent application.

I claim:

1. A modified toilet bowl to ventilate noxious odors emanating therefrom, comprising:

an interior surface;

an exterior surface;

a toilet bowl rim having an upper rim comprising a first upper rim duct cast therein;

a toilet seat and lid positioned on the upper rim;

a plurality of air intake openings from the upper rim duct to the toilet bowl interior surface;

non-collapsible, flexible hollow tubular means of uniform diameter running throughout the upper rim duct within the toilet bowl rim running throughout the upper rim, the flexible hollow tubular means communicating with the toilet bowl interior surface via the air intake openings from the upper rim duct to the toilet bowl interior surface, whereby the flexible hollow tubular means and openings provide an integral, waterproof and airtight passageway from the toilet bowl interior surface through the upper rim;

a vent pipe connected to the flexible hollow tubular means and having an end extending from the toilet bowl exterior surface;

a hollow flexible tubing having two ends with a first end connected to the vent pipe end extending from the toilet bowl exterior surface, and a second flexible tubing end;

hollow tubular means connected to the second flexible tubing end;

one-way valve means within the hollow tubular means;

airflow means in line with the hollow tubular means; and activation means for the airflow means opening the one-way valve means.

2. An improved toilet bowl to ventilate noxious odors emanating therefrom, comprising:

an interior surface;

an exterior surface;

a toilet bowl rim having an upper rim comprising an upper rim duct cast therein;

a toilet seat and lid positioned on the upper rim;

a plurality of air intake openings from the upper rim duct to the toilet bowl interior surface;

a non-collapsible, flexible hollow tube running throughout the upper rim duct within the toilet bowl rim of uniform diameter running throughout the upper rim, the tube communicating with the toilet bowl interior surface via the air intake openings from the upper rim duct to the toilet bowl interior surface, whereby the tube and openings provide an integral, waterproof and airtight passageway from the toilet bowl interior surface through the upper rim;

a vent pipe connected to the tube and having an end extending from the toilet bowl exterior surface;

a hollow flexible tubing having two ends with a first end connected to the vent pipe end extending from the toilet bowl exterior surface, and a second flexible tubing end;

hollow tubular conduit connected to the second flexible tubing end;

one-way valve apparatus within the hollow tubular conduit;

an exhaust fan and motor apparatus in line with the hollow tube; and a pressure activation switch and electrical circuitry assembly whereby once a switch is engaged, airflow means is activated and the one-way valve is aligned in accordance with flow in the direction of desired evacuation.

3. The apparatus of claim 1, wherein airflow means comprises apparatus selected from the group consisting of a vacuum pump assembly, suction blower assembly, and exhaust fan and motor assembly.

4. The apparatus of claim 1, wherein one-way valve means comprises apparatus selected from the group consisting of, a flapper valve, and a check valve.

5. The apparatus of claim 1, wherein activation means comprises a switch and electrical circuitry assembly whereby once a switch is engaged, airflow means is activated and one-way valve means is aligned in accordance with flow in the direction of desired evacuation.

6. The apparatus of claim 5, wherein the switch assembly resides on the toilet seat and whereby the switch assembly is calibrated to be activated by a predetermined weighted mass or manual pressure greater than the weight or pressure of the toilet seat lid upon the toilet seat.

7. The apparatus of claim 5, wherein switch assembly resides on the upper rim and whereby the assembly is calibrated to be activated by a predetermined weighted mass or manual pressure greater than the combined weight or pressure of the toilet seat lid and toilet seat upon the upper rim.

* * * * *